United States Patent [19]

Shah

[11] 4,091,065

[45] May 23, 1978

[54] MELT SPINNING PROCESS

[75] Inventor: Chandrakant Shantilal Shah, Seaford, Del.

[73] Assignee: E. I. Du Pont de Nemours and Company, Wilmington, Del.

[21] Appl. No.: 780,084

[22] Filed: Mar. 22, 1977

[30] Foreign Application Priority Data

Dec. 14, 1976 Canada ..... 267782

[51] Int. Cl.[2] ..... B28B 21/54

[52] U.S. Cl. ..... 264/177 F; 425/397; 425/382 R

[58] Field of Search ..... 264/177 F, 103; 425/397, 382; 57/140 BY

[56] References Cited

U.S. PATENT DOCUMENTS

| | | | |
|---|---|---|---|
| 2,939,201 | 6/1960 | Holland | 264/177 F |
| 3,220,173 | 11/1965 | Pitzl | 264/177 F |
| 3,746,827 | 7/1973 | Martin et al. | 264/177 F |
| 4,001,369 | 1/1977 | Shah | 264/177 F |

*Primary Examiner*—Jay H. Woo

[57] ABSTRACT

The ability to maintain a constant differential between modification ratios of trilobal filaments under cospinning conditions is provided by spinning a filament of lower modification ratio through a spinneret orifice consisting of three radially intersecting tapered slots and a filament of a higher modification ratio through a spinneret orifice configured as three radially intersecting reverse-tapered slots. The orifices configured as three radially reverse-tapered slots provide a high modification ratio with low sensitivity to normal spinning process fluctuations which in combination with orifices having tapered slots for filaments of lower modification ratio facilitate maintenance of a more constant differential in modification ratios between the filaments.

5 Claims, 2 Drawing Figures

MELT SPINNING PROCESS

BACKGROUND OF THE INVENTION

1. Field of the Invention

This invention relates to a process for cospinning synthetic trilobal filaments differing in modification ratios. More particularly, the filaments are cospun from trilobal spinneret orifices of different configurations.

2. Description of the Prior Art

Synthetic filaments having trilobal cross-sections and particular benefits associated therewith are described, for example, in U.S. Pat. No. 2,939,201. A characteristic of such filaments is their cross-section modification ratio, or MR. Certain benefits can be obtained from mixtures of such filaments or fibers having different modification ratios as described, for example, in U.S. Pat. No. 3,220,173. A convenient method of preparing such filament mixtures is to co-spin the different types in the desired ratio and to process the combined filaments through subsequent steps such as drawing, crimping, cutting into staple, etc. as a single mixed-filament product.

When filaments of two different modification ratios are co-spun using two differently dimensioned sets of known capillaries such as those with three intersecting slots with each having parallel sides, random fluctuations in process variables such as spinning temperature cause MR changes along and among filaments. Process adjustments to maintain an acceptable difference in MR between the two filament species is quite difficult.

An object of this invention is to reduce the sensitivity to normal spinning process fluctuations of changes in the difference in modification ratios among filaments cospun from a common polymer supply through at least two spinning capillaries designed to yield different filament modification ratios and where one of the modification ratios is greater than 1.9.

SUMMARY OF THE INVENTION

The invention is an improvement in a process for cospinning at least two synthetic trilobal filaments from the same polymer melt wherein one filament has a modification ratio no greater than 1.9, the other filament has a modification ratio greater than 1.9, and the two filaments differ in their modification ratios by at least 0.3 and preferably by at least 0.6 MR units. The improvement comprises spinning the filament of lower modification ratio through a spinneret capillary configured as three radially intersecting tapered slots and spinning the filament of higher modification ratio through a spinneret capillary configured as three radially intersecting reverse-tapered slots.

Preferably the tapered and reverse-tapered slots are tapered to define an angle of from about 3° to about 15° between intersecting imaginary lines which are extensions of the sides of a given slot.

DESCRIPTION OF THE DRAWINGS

In FIG. 1, symmetrical capillary 20 consists of three radially intersecting slots 22 whose imaginary center lines 23 intersect at center point 24. Each slot 22 has the same length 25 measured between center point 24 and flat tip 28 which is perpendicular to center line 23. Each slot 22 is tapered such that the base width 26 is greater than the width of tip 28 to define a taper angle B between imaginary extensions 29 of the sides of slot 22. Angle C between adjacent slots 22 is shown equal in each instance (120°).

In FIG. 2, symmetrical capillary 30 consists of three radially intersecting slots 32 whose imaginary center lines 33 intersect at center point 34. Each slot 32 has the same length 35 measured between center point 34 and flat tip 37 which is perpendicular to center line 33. Each slot 32 is reverse-tapered such that the base width 36 is less than width 38 of tip 37 to define a taper angle D between imaginary extensions 39 of the sides of slot 32. Angle E between adjacent slots 32 is shown equal in each instance (120°).

Although the capillaries of the Figures are shown to be symmetrical in each instance, symmetry is not a requirement of this invention provided the specific shape conditions are met. For example, lengths 25 or 35 and angles C or E may differ among slots in the same capillary. The slot tips of all three capillary types may be squared, rounded, expanded, or otherwise modified as known in the art without changing their relative performances as described herein.

DESCRIPTION OF THE INVENTION

Spinneret capillaries for spinning trilobal filaments configured as three radially intersecting slots which radiate from a common point are well-known. The modification ratios of filaments spun from such capillaries are affected not only by configuration and size of the capillary but also by spinning conditions such as polymer relative viscosity, spinning temperature, and quenching conditions used for solidifying the freshly spun filaments. When using a common polymer supply and identical spinning and quenching conditions (i.e., when cospinning) to produce filaments having a desired constant difference in modification ratios, such fluctuations in processing conditions can have a highly undesirable effect upon the modification ratio differential. This invention facilitates maintenance of a fixed differential in modification ratio between filaments under such normal fluctuating conditions when one filament has a modification ratio greater than 1.9.

The process of this invention is particularly useful for cospinning filaments in the manufacture of crimped staple fibers for use in carpet yarn wherein the filaments of one group have a modification ratio within the range of 1.6 to 1.9 and the filaments of another group have a modification ratio within the range of 2.2 to 2.5.

Figure 1:
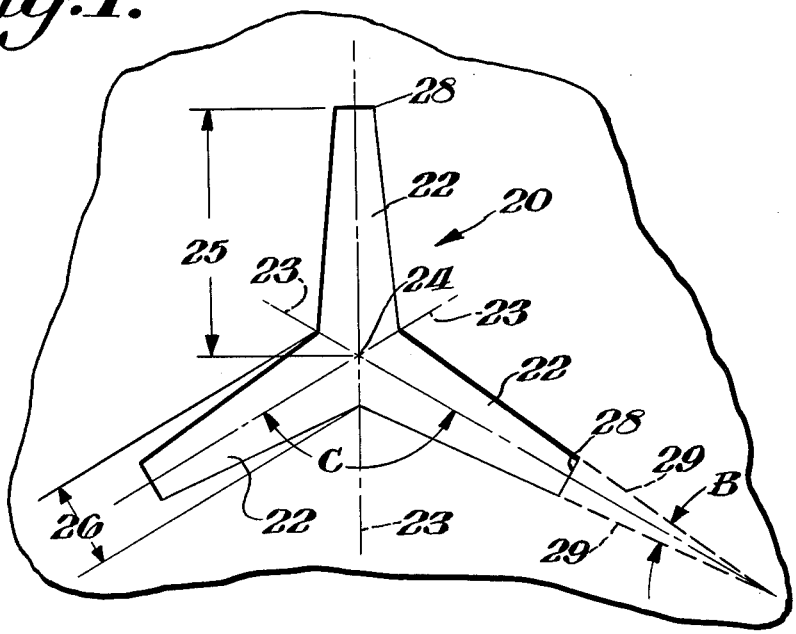
FIG. 1 represents the magnified transverse cross-section of a spinneret capillary comprised of three radially intersecting tapered slots.

The modification ratio of filaments spun through tapered trilobal capillaries as in FIG. 1 is relatively insensitive to changes in spinning conditions. Unfortunately, the highest modification ratio practicably obtainable with such capillaries is only about 1.9. Therefore, the tapered slot configuration is not suitable for the high MR filaments of this invention which have an MR in excess of 1.9 (preferably 2.2 to 2.5).

"Modification ratio" (MR) as used herein is defined as the ratio of the radius of a circle which circumscribes the filament cross-section to the radius of the largest circle which can be inscribed within the filament cross-section. For filament cross-sections having substantially equal lobes, these circles are concentric as described in Holland U.S. Pat. No. 2,939,201.

The MR of each filament type is determined on the as-spun filaments prior to any cold-drawing step by measuring 10 filaments of each particular filament type and calculating the average. In actual practice, the measurements are made on photographic enlargements of carefully microtomed cross-sections of undrawn yarn. Considering method error, a constant MR is assumed when none of the individual measurements differ from the average by more than ± 0.15 MR units.

"Relative viscosity" (RV) is the ratio of absolute viscosities at 25° C of a polymer solution to its solvent. In the Examples, the solvent is formic acid/water (90/10 parts by weight) and the solution is prepared by dissolving 5.5 gm. of dried polymer in 50 ml. (25° C) of the solvent. As employed herein, the "polymer" is always a sampling of freshly extruded filaments.

The term "cospinning", as used herein, applies not only to spinning two types of filaments through different capillaries in the same spinneret, but also to spinning through at least two spinnerets of the same spinning machine where all capillaries of each spinneret are identical but differ from spinneret to spinneret. In any case, the filaments of both types are spun from a common polymer supply under substantially identical spinning conditions and are combined to provide a mixed filament or fiber product.

Polymers useful in the process of this invention are any of those conventionally melt spun. Polyamides are preferred, including polyhexamethylene adipamide (66 nylon), polycaproamide (6 nylon), and their copolymers. Polyesters (e.g., polyethylene terephthalate), copolyesters, and polyalkylene polymers (e.g, polypropylene and its copolymers) are also advantageously employed.

In the following examples filaments are extruded from a supply of poly(hexamethylene adipamide) containing 0.02% by weight $TiO_2$ delusterant as very fine dispersed particles. A screw-melter converts the flake polymer to polymer melt. Relative viscosity of the melt is varied as desired by controlling temperature and relative humidity of recirculating inert gas in a conditioner through which flake passes before being melted. Nominal RV of the extruded polymer is about 66, but, as specified hereinafter, RV is varied over a range of 60 to 72 to test the effect of RV on MR. Unless otherwise specified, extrusion temperature of the melt is 290 ± 2° C.

Filaments in each example are produced at a single position fitted with a spinneret plate having 332 extrusion capillaries arranged in 8 parallel rows in staggered array such that each odd-numbered row has 42 and each even-numbered row 41 capillaries. All capillaries in odd-numbered rows are identical with a given trilobal cross-section, and all capillaries in even-numbered rows are identical with a different trilobal cross-section. Exact cross-sections are specified hereinafter. The polymer melt is spun to filaments at the rate of 110 lb./hr. (49.9 kg./hr.), and the filaments are quenched in a chimney using cross-flow air at 45 ± 3° F. (7.2 ± 7° C) and quench-air flow rates of from 290 to 380 ft.$^3$/min. (8.21 to 10.76 m.$^3$/min.), as subsequently specified. The quenched filament bundle is then collected as a tow which, in a separate operation, is drawn at a draw-ratio of 3.75X and crimped conventionally in a stuffer-box crimper. All filaments so prepared are nominally of 18 dpf (20 dtex).

EXAMPLE I

This Example utilizes a spinneret plate having only the tapered insensitive capillaries of FIG. 1 and consequently is not of the invention.

The odd-numbered rows in the spinneret plate (producing the low-MR species) have capillaries characterized by: slot length 25 is 14.0 mils (0.36 mm.), base width 26 is 7.0 mils (0.18 mm.), width of flat tip 28 is 4.3 mils (0.11 mm.), taper angle B is 12.8°, and symmetrical slot angle C is 120°. Capillary length is 4.0 mils (0.10 mm.).

The even-numbered rows (producing the high-MR species) have capillaries characterized by: slot length 25 is 17 mils (0.43 mm.), base width 26 is 7.6 mils (0.19 mm.), width of flat tip 28 is 4.8 mils (0.12 mm.), taper angle B is 3.25°, and symmetrical slot angle C is 120°. Capillary length is 8.0 mils (0.20 mm.).

Measured filament modification ratios under the shown spinning conditions are:

| Low MR Values - | | | | | |
|---|---|---|---|---|---|
| Quench-air flow | | Yarn RV | | | MR |
| ft.$^3$/min. | m.$^3$/min. | 60±3 | 66±3 | 72±3 | Change |
| 290 | 8.21 | 1.65 | 1.70 | 1.75 | 0.10 |
| 320 | 9.06 | 1.70 | 1.65 | 1.75 | 0.10 |
| 350 | 9.91 | 1.70 | 1.70 | 1.80 | 0.10 |
| 380 | 10.76 | 1.65 | 1.80 | 1.80 | 0.15 |
| | MR Change | 0.05 | 0.15 | 0.05 | |

| High MR Values - | | | | | |
|---|---|---|---|---|---|
| Quench-air flow | | Yarn RV | | | MR |
| ft.$^3$/min. | m.$^3$/min. | 60±3 | 66±3 | 72±3 | Change |
| 290 | 8.21 | 1.75 | 1.80 | 1.85 | 0.10 |
| 320 | 9.06 | 1.80 | 1.80 | 1.90 | 0.10 |
| 350 | 9.91 | 1.75 | 1.85 | 1.85 | 0.10 |
| 380 | 10.76 | 1.80 | 1.90 | 1.95 | 0.15 |
| | MR Change | 0.05 | 0.10 | 0.10 | |

These results show that the MR from each set of capillaries is relatively insensitive to process variables and the differential between sets remains relatively constant; however, the desired differential of 0.3 between sets was not obtained in spite of the differences in capillary dimensions.

EXAMPLE II

Figure 2:
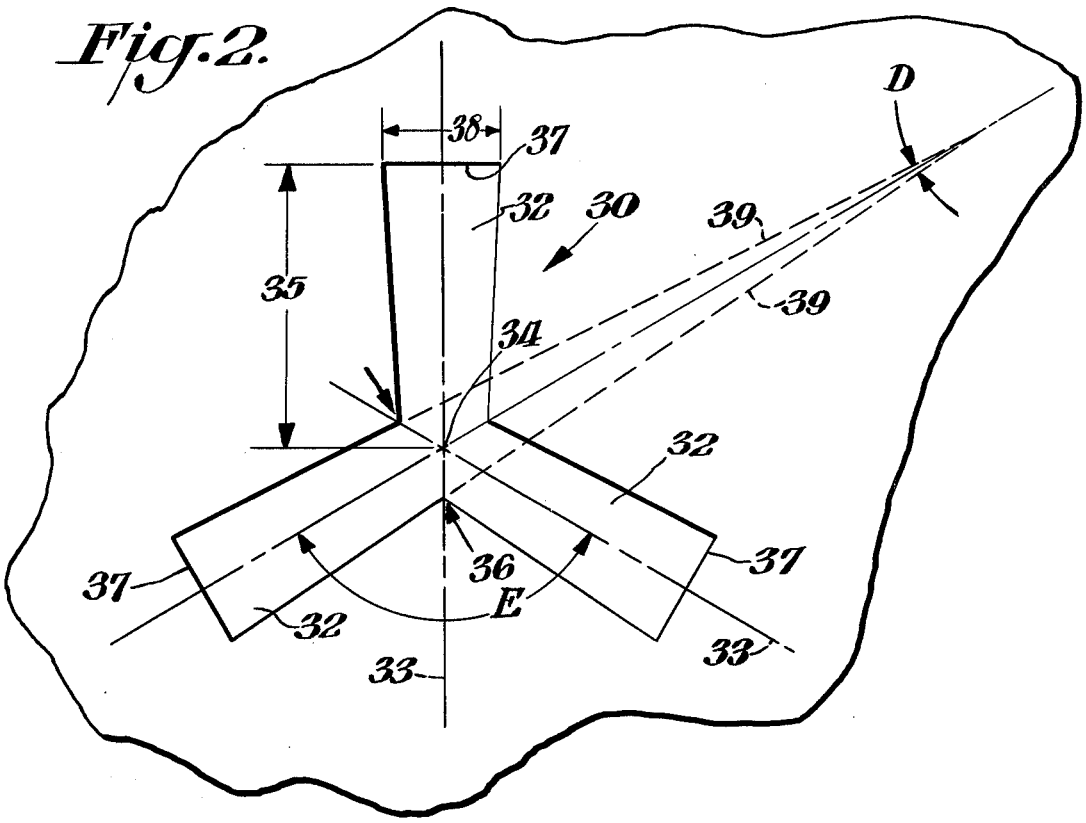
FIG. 2 represents the magnified transverse cross-section of a spinneret capillary comprised of three radially intersecting reverse-tapered slots.

This example shows cospinning two species differing in MR by at least 0.3 MR units and having a high MR in excess of 1.9 and a low MR less than 1.9. The odd-numbered rows of the spinneret plate (producing the low-MR component) have tapered capillaries (FIG. 1) identical to those of the odd-numbered rows in Example I. The even-numbered rows (producing the high-MR component) have reverse-tapered capillaries as shown in FIG. 2 and characterized by: slot length 35 is 18.3 mils (0.46 mm.), base width 36 is 5.7 mils (0.14 mm.), flat tip width 38 is 7.6 mils (0.19 mm.), reverse taper angle D is 6.5°, and symmetrical slot angle E is 120°. Capillary length is 8.0 mils (0.20 mm.).

Modification ratios obtained with changes in quench air flow and RV are:

| Low MR Values - | | | | | |
|---|---|---|---|---|---|
| Quench-air flow | | Yarn RV | | | MR |
| ft.$^3$/min. | m.$^3$/min. | 60±3 | 66±3 | 72±3 | Change |
| 290 | 8.21 | 1.65 | 1.70 | 1.70 | 0.05 |
| 320 | 9.06 | 1.60 | 1.65 | 1.75 | 0.15 |
| 350 | 9.91 | 1.65 | 1.75 | 1.70 | 0.10 |
| 380 | 10.76 | 1.70 | 1.70 | 1.75 | 0.05 |
| | MR Change | 0.10 | 0.10 | 0.05 | |

-continued

| High MR Values - | | | | | |
|---|---|---|---|---|---|
| Quench-air flow | | Yarn RV | | | MR |
| ft. $^3$/min. | m.$^3$/min. | 60±3 | 66±3 | 72±3 | Change |
| 290 | 8.21 | 2.35 | 2.40 | 2.55 | 0.20 |
| 320 | 9.06 | 2.30 | 2.35 | 2.55 | 0.25 |
| 350 | 9.91 | 2.40 | 2.45 | 2.60 | 0.20 |
| 380 | 10.76 | 2.45 | 2.55 | 2.65 | 0.20 |
| | MR Change | 0.15 | 0.20 | 0.10 | |

Modification ratios obtained with changes in quench air flow and extrusion temperature are:

| Low MR Component (RV 66±3) | | | | | |
|---|---|---|---|---|---|
| | | MR Values - | | | |
| Quench-air flow | | Extrusion Temperature | | | MR |
| ft. $^3$/min. | m.$^3$/min. | 287° C | 291° C | 295° C | Change |
| 290 | 8.21 | 1.65 | 1.70 | 1.75 | 0.10 |
| 380 | 10.76 | 1.70 | 1.75 | 1.80 | 0.10 |
| | MR Change | 0.05 | 0.05 | 0.05 | |

| High MR Component (RV 66±3) | | | | | |
|---|---|---|---|---|---|
| | | MR Values - | | | |
| Quench-air flow | | Extrusion Temperature | | | MR |
| ft. $^3$/min. | m.$^3$/min. | 287° C | 291° C | 295° C | Change |
| 290 | 8.21 | 2.30 | 2.45 | 2.55 | 0.25 |
| 380 | 10.76 | 2.40 | 2.60 | 2.65 | 0.25 |
| | MR Change | 0.10 | 0.15 | 0.10 | |

Comparison of the MR changes for this high-MR component with those of this low-MR component reveals that the reverse-tapered high MR capillary of FIG. 2 is only slightly more sensitive to process variables, than is the tapered capillary of FIG. 1. The ranges of RV and quench air-flow investigated in the example are broader than any variations normally anticipated in a given commercial production process. Thus, using the tapered capillary of FIG. 1 for a low-MR component cospun with a high-MR component utilizing the reverse-tapered capillary of FIG. 2 yields a MR differential which is constant within the normal accuracy of detection of shifts in MR which affect product quality.

What is claimed is:

1. In a process for cospinning at least two synthetic trilobal filaments from the same polymer melt wherein one filament has a modification ratio no greater than 1.9 and the other filament has a modification ratio greater than 1.9 and the two filaments differ in their modification ratios by at least 0.3, the improvement comprising spinning the filament of lower modification ratio through a spinneret orifice configured as three radially intersecting tapered slots and spinning said other filament through a spinneret orifice configured as three radially intersecting reverse-tapered slots.

2. The process of claim 1 wherein the tapered slots and the reverse-tapered slots have a taper angle of from about 3° to about 15°.

3. The process of claim 2 wherein the modification ratio of the one filament is from about 1.6 to about 1.9 and the modification ratio of the other filament is from about 2.2 to 2.5.

4. The process of claim 1 wherein the difference in modification ratio between the one filament and the other filament is at least 0.6.

5. The process of claim 1 wherein the polymer is poly(hexamethylene adipamide).

* * * * *